US007434364B2

(12) United States Patent
MacDermott et al.

(10) Patent No.: US 7,434,364 B2
(45) Date of Patent: Oct. 14, 2008

(54) WALL PANEL ARRANGEMENT

(75) Inventors: Scott MacDermott, Calgary (CA); Laura A. Walker, Calgary (CA)

(73) Assignee: Haworth, Ltd., Calgary, Alberta (CA)

( * ) Notice: Subject to any disclaimer, the term of this patent is extended or adjusted under 35 U.S.C. 154(b) by 276 days.

(21) Appl. No.: 11/304,392

(22) Filed: Dec. 15, 2005

(65) Prior Publication Data

US 2007/0137124 A1 Jun. 21, 2007

(51) Int. Cl.
*E04B 2/00* (2006.01)

(52) U.S. Cl. ..... 52/584.1; 52/581; 52/127.11

(58) Field of Classification Search ..... 52/584.1, 52/581, 578, 127.2, 127.11, 282.1, 285.2; 403/43, 44, 45, 48; 160/135
See application file for complete search history.

(56) References Cited

U.S. PATENT DOCUMENTS 1,893,481 A * 1/1933 Adams ..... 52/489.1
2,170,637 A * 8/1939 Hatch et al. ..... 52/584.1
2,708,013 A 5/1955 Kullmer
2,795,305 A 6/1957 Bagge
2,805,739 A 9/1957 Dennison
3,267,631 A * 8/1966 Hammitt ..... 52/771
3,430,997 A 3/1969 Propst et al.
3,517,467 A * 6/1970 Kelley et al. ..... 52/36.6
3,778,956 A * 12/1973 Martin ..... 52/584.1
4,457,117 A * 7/1984 Leiher et al. ..... 52/238.1
4,497,148 A 2/1985 Lopez
4,567,698 A * 2/1986 Morrison ..... 52/36.6
4,635,422 A 1/1987 Nowack et al.
4,698,945 A * 10/1987 Munn ..... 52/220.2
4,786,201 A * 11/1988 Huetter et al. ..... 403/22
4,999,958 A 3/1991 Harrison
5,058,347 A 10/1991 Schuelke et al.
5,233,803 A * 8/1993 Bockmiller ..... 52/239
5,363,612 A 11/1994 Erickson
5,414,967 A * 5/1995 Cates et al. ..... 52/281
5,485,704 A * 1/1996 Sandor, Sr. ..... 52/584.1
5,625,991 A 5/1997 Sturrus
5,636,484 A 6/1997 DeBlock
6,016,632 A * 1/2000 McGee et al. ..... 52/241
6,421,968 B2 7/2002 Degelsegger

* cited by examiner

*Primary Examiner*—Robert Canfield
*Assistant Examiner*—Jessie Fonseca
(74) *Attorney, Agent, or Firm*—Flynn, Thiel, Boutell & Tanis, P.C.

(57) ABSTRACT

A pair of upright wall panels are each provided with a sidewardly spaced pair of generally parallel but inclined guide grooves extending vertically along the outer face of the upright frame edge rails. A connector assembly including a main activator rod having a pair of wedge members threaded thereon in spaced relationship therealong is positioned between the opposed upright edge rails. The wedge members have wedgelike edge flanges which protrude into the grooves of the opposed upright edge rails. Rotation of the activating rod causes the wedge members to simultaneously move relative to the rod in opposite directions between a first end position wherein the wedge members effect gripping engagement with the groove walls to simultaneously effect a drawing together of the edge rails and alignment thereof, and a second end position wherein the wedge members clampingly engage only a single edge rail to facilitate initial mounting of the connector assembly.

17 Claims, 7 Drawing Sheets

WALL PANEL ARRANGEMENT

CROSS-REFERENCE TO RELATED APPLICATION

This application is related to copending application Ser. No. 10/867,565, filed Jun. 14, 2004, and owned by the Assignee hereof. This earlier Ser. No. 10/867,565 application is, in its entirety, incorporated herein by reference.

FIELD OF THE INVENTION

This invention relates to an upright wall panel arrangement, including prefabricated wall panels which include a supporting frame, and more specifically relates to an improved hidden connector arrangement compactly disposed between opposed upright frame rails of adjacent panels for drawing adjacent panels together in aligned relationship.

BACKGROUND OF THE INVENTION

Prefabricated upright panels of the type utilized for dividing interior workspaces are rigidly interconnected utilizing a wide range of connector structures which, in many instances, are constructed so as to be hidden in use, but which are often difficult to access. In many instances access to such connectors is vertically from above, and in such instance such connector is normally feasible for use only with panels which are less than floor-to-ceiling height. Additionally, many of the connectors which are accessible from the sides of the panels are, if uncovered, visually distracting, and hence such wall panels require additional auxiliary covers for hiding the connectors and improving the appearance of the assembled wall. The type and nature of connector also is a function of the type of construction of the prefabricated wall panel and, in some instances, such as when the panel is defined dominantly by a vertically enlarged glass panel having a surrounding edge frame, the provision of an adequate connector for joining adjacent upright panels is further complicated by the limited available space provided by the edge frames of the panels. In many instances, particularly when the panels are of the type referred to as "glass" panels, the frames of adjacent upright panels are frequently connected by vertically elongate splines connected between opposed vertical edges of the panel frames, or alternatively the adjacent vertical edges of the panel frames are joined by threaded fasteners extending therebetween. Such arrangements, however, have proven troublesome with respect to their ability to effect proper drawing together of the panels and at the same time maintaining desired aligned relationship between the panels.

In an effort to provide an improvement with respect to the above, there is disclosed in copending application Ser. No. 10/867,565, owned by the Assignee hereof, an improved connector which cooperates between the opposed upright edge rails of adjacent panels so as to effect drawing together and aligning of the adjacent panels to achieve a fixed connection therebetween, while at the same time permitting the connector to be of a small and compact structure so as to be conveniently disposed in a small space between the opposed adjacent edge rails, thereby providing a wall panel arrangement having desirable compactness and aesthetics. In the improved connector of the aforementioned copending application, the connector employs a pair of wedge members which are engaged on an activating rod through threaded connections of opposite hand so that rotation of the activating rod causes the wedge members to move axially of the activating rod in opposite directions. The wedge members cooperate with opposed wedgelike elements on the edge rails by effecting drawing in and aligning of the edge rails so as to create a fixed connection between the edge rails. While this connector and its cooperation with the edge rails has proven desirable for achieving the objective of aligning and fixing the edge rails of adjacent panels together while providing a small and compact connector arrangement, nevertheless further development efforts have been carried to provide improved performance and specifically to provide greater ease of insertion and assembly of the connector to the opposed edge rails to hence facilitate the job-site installation of the wall assembly.

Accordingly, it is an object of this invention to provide improvements with respect to a connector of the general type disclosed in the aforementioned copending application, and specifically improvements which facilitate initial insertion and application of the connectors into engagement with the edge rails of adjacent panels to facilitate the fixed securement therebetween.

In the upright wall panel arrangement of the present invention, a pair of vertically large upright wall panels, each generally preassembled and provided with a surrounding rigid frame, are provided with a sidewardly spaced pair of generally parallel guide grooves extending vertically along the outer face of the upright frame edge rails. A connector assembly including a main activator shaft or rod having a pair of wedge nuts threaded thereon in spaced relationship therealong is positioned between the pair of opposed upright edge rails associated with a pair of adjacent panels. The wedge nuts, which are oppositely threadedly engaged on the activating rod, have wedgelike edge flanges which protrude into the guide grooves of the opposed upright edge rails. Rotation of the activating rod, as by inserting an activating tool through a narrow upright slot defined between the adjacent edge rails, causes the wedge nuts to be simultaneously moved relative to the rod and in opposite directions with respect to one another so as to effect gripping engagement with the guide grooves of the opposed edge rails, thereby simultaneously effecting not only a drawing together of the edge rails, but also alignment thereof to effect a fixed and aligned securement of the adjacent panels to one another. One of the wedgelike edge flanges on each wedge nut has an enlarged clamping portion which projects axially in a direction away from the gripping position so that, when the activating rod is rotated to effect simultaneous movement of the wedge nuts away from the gripping position, the clamping portions located on one side of the wing nuts move into clamping engagement with an opposed side wall of the respective guide groove, whereby the connector can be fixedly secured and hence held in a desired position solely due to its engagement with one edge rail. This enables the connectors to be properly and easily secured to an edge rail of one panel, following which the adjacent panel can be moved into position so that the wedgelike edge flanges on the other side of the connector protrude into the opposed guide rails. When so positioned, the activator rods on the individual connectors can then be appropriately rotated so as to release the clamping portions from clamping engagement, thereby moving the wedge nuts toward the opposed sides of the guide grooves to effect the desired wedgelike engagement which both aligns and draws the panels together into the desired fixed relationship.

Other objects and purposes of the invention will be apparent to persons familiar with constructions of this type upon reading the following specification and inspecting the accompanying drawings.

Figure 1:
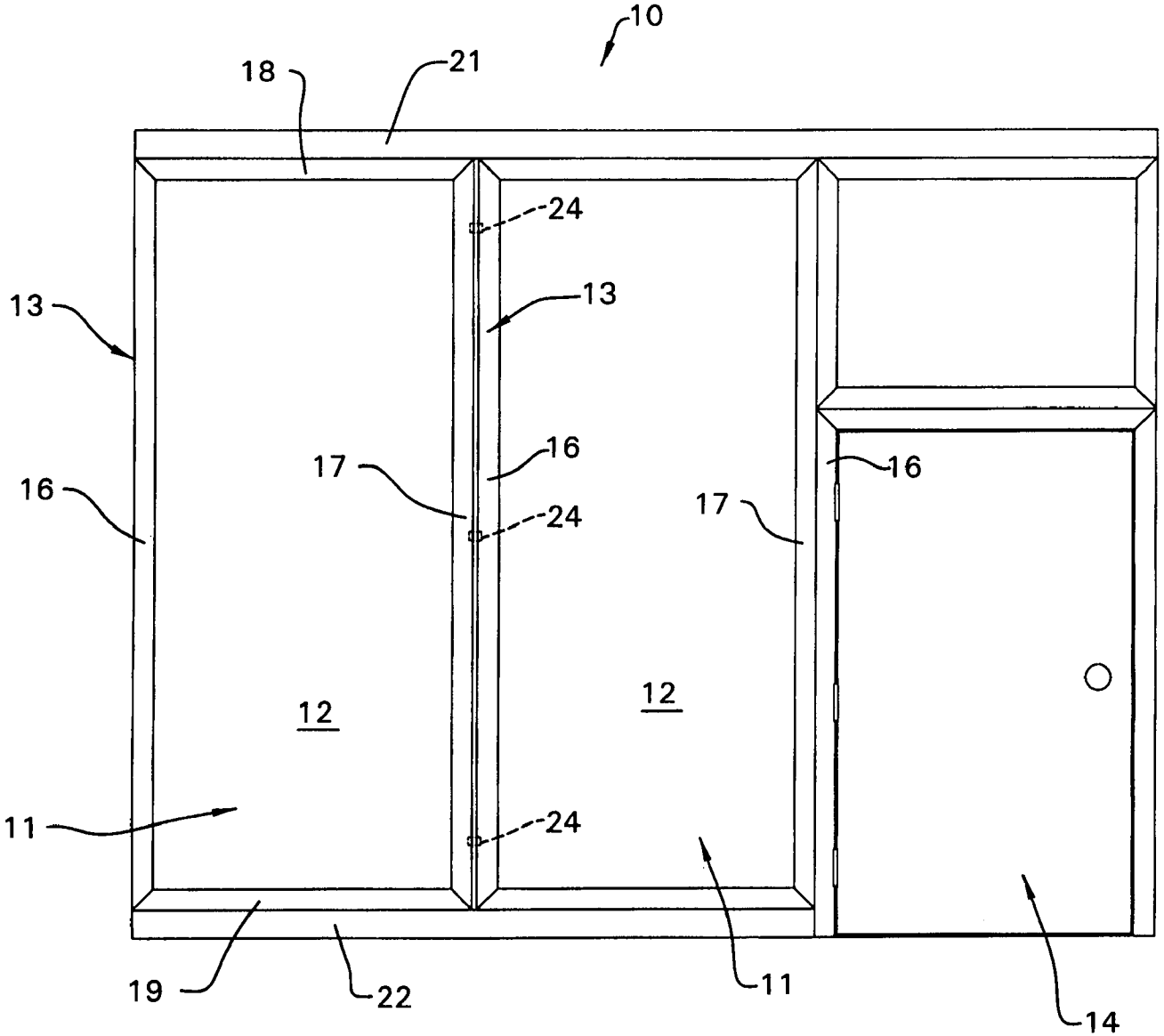
FIG. 1 is a front elevational view illustrating part of an upright interior wall system which, in this diagrammatic illustration, includes three upright panels disposed in adjacent, aligned and fixedly interconnected relationship to one another.

Certain terminology will be used in the following description for convenience in reference only, and will not be limiting. For example, the words "upwardly", "downwardly", "rightwardly" and "leftwardly" will refer to directions in the drawings to which reference is made. The words "upper" or "upward" will also be used in reference to the normal orientation of the wall arrangement. Said terminology will include the words specifically mentioned, derivatives thereof, and words of similar import.

DETAILED DESCRIPTION

Figure 2:
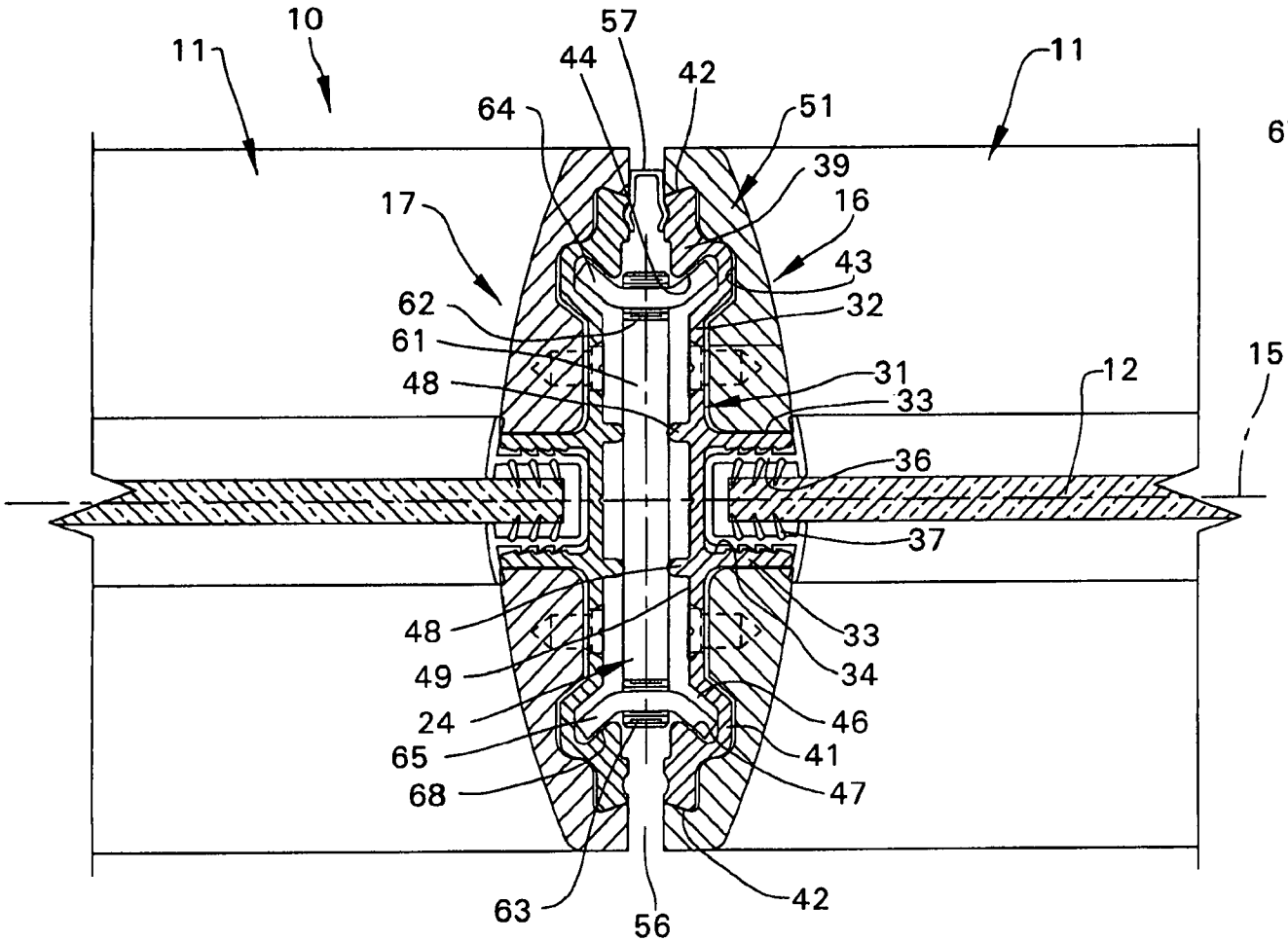
FIG. 2 is an enlarged fragmentary cross-sectional view taken generally along line II-II in FIG. 1 and illustrating the edge frames of the panels and their connection by the connector assembly of aforesaid Ser. No. 10/867,565.
Figure 4:
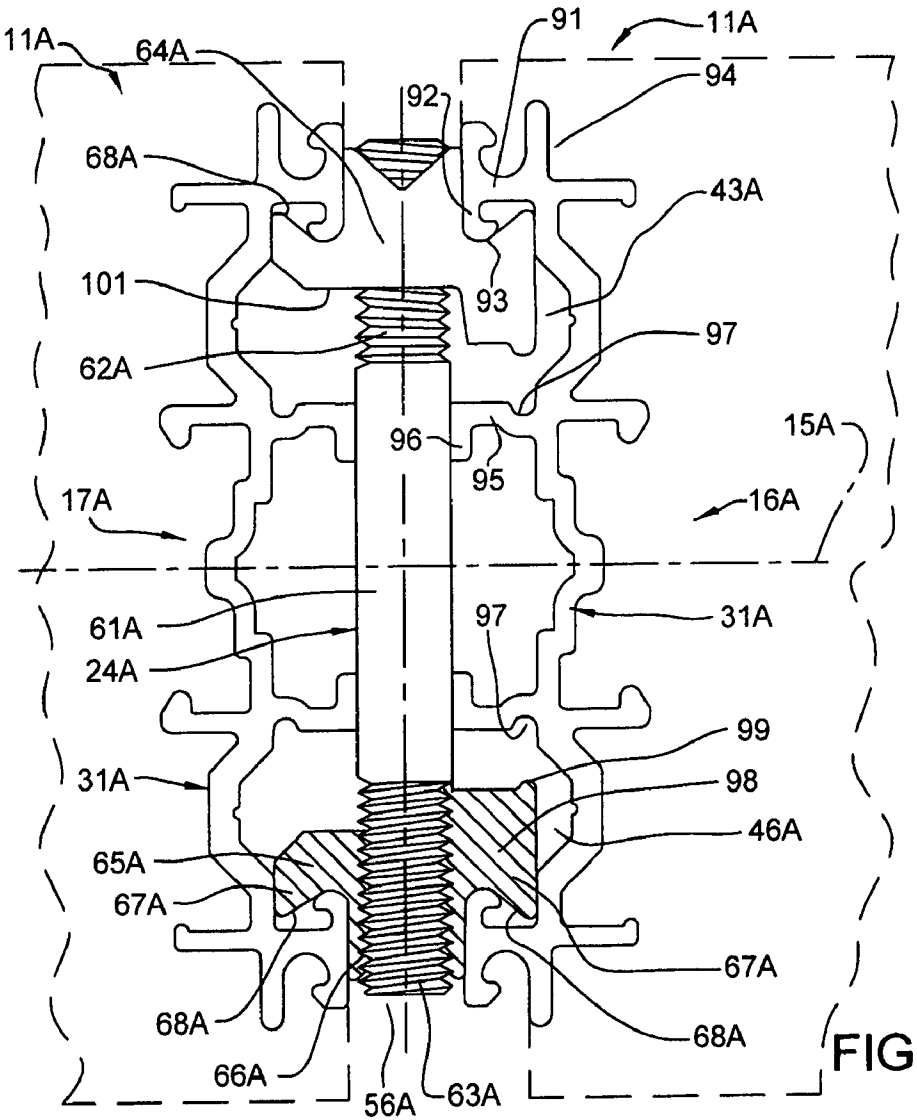
FIG. 4 is a view similar to FIG. 2 but illustrating an improved connector assembly according to the present invention, the connector assembly being shown in a position wherein it is lockingly connecting opposed edge rails of adjacent upright panels.
Figure 5:
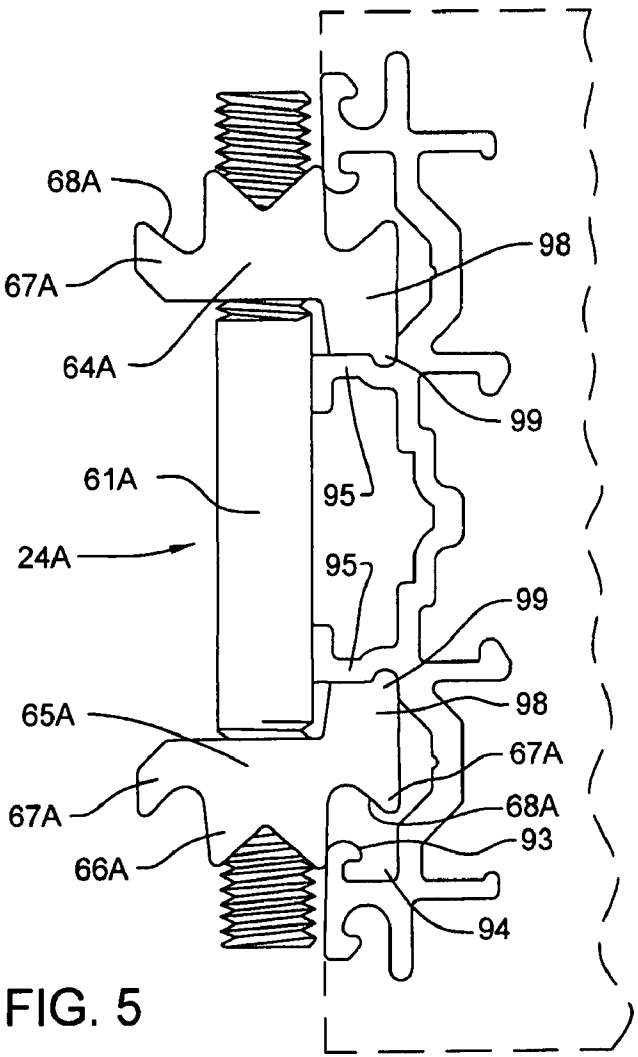
FIG. 5 illustrates the connector of FIG. 4 shown attached to a single upright edge rail, prior to its connection to the opposed edge rail of an adjacent wall panel.
Figure 6:
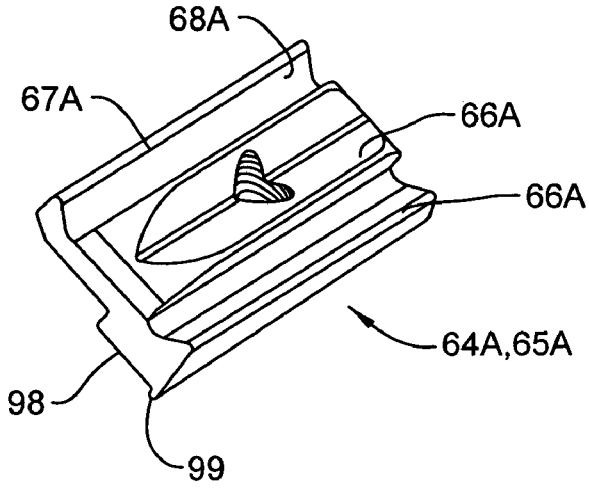
FIG. 6 is a perspective view of the wedge member associated with the connector assembly of FIGS. 4 and 5.

FIGS. 1 and 2 hereof correspond to figures presented in Assignee's copending Ser. No. 10/867,565, and are presented herein so as to provide a description of not only the environment associated with the present invention, but also the background associated with the connector disclosed in the aforementioned application. This background information is presented so as to provide a basis for the subsequent discussion of the improvements associated with the improved connector assembly of this invention as illustrated by FIGS. 4-5.

FIG. 1 illustrates an upright wall arrangement 10 for dividing large interior spaces into smaller workspaces, such as for offices and the like. The wall arrangement 10 includes upright and generally rectangular wall panel assemblies 11 which as illustrated are generally identical, although it will be appreciated that such wall panel assemblies can be of different widths and/or heights. One wall panel assembly, as indicated at 14, may be formed to define a door assembly.

The wall panel assembly 11 includes a primary center panel or core 12 which defines the primary vertical and horizontal extent of the panel assembly. This center panel 12 is supported by a surrounding exterior frame 13 which engages and extends along the peripheral edges of the center panel 12.

The frame 13, in a generally conventional manner, is defined by generally parallel, upright side edge frame rails 16 and 17 which define opposite side edges of the panel assembly, and the rails 16 and 17 have opposite ends thereof rigidly joined together by generally parallel top and bottom edge frame rails 18 and 19 which extend generally perpendicularly therebetween, whereby the frame is generally rectangular.

The wall panel assemblies 11, in the illustrated arrangement, function as floor-to-ceiling panels, and have upper edges thereof supportingly engaged with a horizontally elongate top support rail 21 which is typically fixed to the ceiling. The bottoms of the panel assemblies 11 are typically supported on a horizontally elongate bottom support rail 22 which is fixed to the floor or is provided with grippers for engaging a carpet.

To connect a pair of upright wall panel assemblies 11 in rigid, adjacent and horizontally aligned edge-to-edge relationship (i.e., the aligned panels are substantially vertically coplanar), as diagrammatically illustrated in FIG. 1, the wall arrangement 10 may utilize a plurality of vertically-spaced connector assemblies 24 (FIG. 2) to rigidly couple the side edge frame rail 16 on one panel assembly and the adjacent side edge frame rail 17 of the adjacent panel assembly. These edge rails 16 and 17 are basically mirror images of one another and, in the FIG. 2 embodiment, are identical.

The upright edge frame rail 16 includes an upright edge member 31 which extends vertically throughout substantially the full height of the wall panel assembly, which edge member 31 in this embodiment is formed preferably as a one-piece aluminum extrusion. The edge member 31 is defined principally by a main upright center wall 32 of a platelike construction which extends in the transverse or thickness direction of the wall panel assembly. This main center wall 32 has, on the inner side thereof, a pair of generally parallel side flanges 33 which project inwardly in generally perpendicular relationship from the center wall 32 and which cooperate with the center wall 32 to define a generally inwardly opening U-shaped channel 34. This channel 34, which in this embodiment is positioned so that the center plane thereof is disposed generally on the vertical center plane 15 of the wall panel assembly, accommodates a generally U-shaped glazing strip 36 which effectively lines the channel 34 and extends vertically therealong. This glazing strip 36, which is of a plastic or other suitable material having at least limited resiliency, has a plurality of resilient tabs 37 cantilevered inwardly from the opposed inner side walls for resilient gripping engagement with opposite side surfaces of the edge portion of the center core panel 12 which, in this illustrated embodiment, is a large platelike glass panel.

The upright edge member 31 also includes, on opposite sides of and spaced outwardly from the channel 34, a pair of edge parts 39 and 41 which are enlarged in cross section relative to the center wall part 32, and extend vertically along the upright edge member 31 adjacent but spaced slightly inwardly from opposite side edges of the frame rail 16. The edge parts 39 and 41 each terminate in an outer free edge 42 which defines the outer upright edge of the member 31. The spacing between the edges 42 in this embodiment is slightly less than the overall transverse width of the frame as defined, for example, by the width of the upright frame rail 16.

The enlarged edge part 39 defines therein a groove 43 which opens inwardly from the outer surface 49 of the edge member, which outer surface 49 is the exposed edge surface of the prefabricated wall panel assembly prior to such panel being rigidly secured in aligned relationship to other similar wall panel assemblies. The groove 43 is elongated vertically throughout the length of the edge member 31 and, on at least one side thereof, defines a side wall 44 which is generally flat in the illustrated embodiment, and which extends inwardly away from the outer wall 49 in angled but non-perpendicular relationship relative to the central upright plane 15 of the wall panel assembly.

The other enlarged edge part 41 has a similar groove 46 which extends vertically throughout the length of the edge member 31 and opens inwardly from the outer edge surface 49. The groove 46 defines a wall 47 on at least one side thereof which in the illustrated embodiment is also flat and which angles as it projects away from the edge surface 49, which wall 47 angles in non-perpendicular relationship relative to the center upright plane 15.

The grooves 43 and 46 are preferably substantially identical to but mirror images of one another relative to the center upright plane 15. In this disclosed arrangement, the sloped side surfaces 44 and 47 of the grooves, which effectively function as gripping and wedging surfaces as explained hereinafter, are defined as the outer side surfaces of the respective grooves, and these side surfaces as they project away from the generally flat outer edge surface 49 toward the bottom of the respective groove are sloped or angled outwardly generally toward the respective exposed upright side surfaces of the wall panel assembly. The side or wedging surfaces 44 and 47 preferably slope (i.e. toward the bottom of the respective closed groove) at an angle in the range of about 20° to about 40°, preferably about 30°, relative to the central vertical plane 15. The pair of sloped side surfaces 44 and 47 as described above thus diverge away from one another as the side walls project toward the bottom of the respective grooves.

The edge member 31, as illustrated in FIG. 2, also has a pair of small but generally parallel ribs 48 cantilevered outwardly in sidewardly spaced relation from the outer edge surface 49 and extending vertically throughout the lengthwise extent thereof. The ribs 48 are preferably rounded at the outer free ends and effectively function as positioning stops which engage the connector assembly 24 when the latter connects adjacent panel assemblies in fully assembled relationship.

The upright edge frame rail 16, in the embodiment of FIG. 2, includes not only the edge member 31 but also includes a pair of vertically elongate trim strips 51 which overlie the inner surface of the edge member 31, on opposite sides of the glass pane 12, for providing a more desirable appearance. The trim strips 51 can be suitably secured to the edge member 31 in a conventional manner.

The opposed assembled edge frame rails 16 and 17, when positioned in adjacent aligned relationship and fixedly interconnected by the connector assembly 24 as illustrated in FIG. 2, result in a small slot 56 being defined therebetween, which slot 56 opens transversely through the thickness of the wall assembly, and extends generally vertically throughout the height thereof. This slot 56 is preferably of very small horizontal width, such as for example about ¼ inch, and can be closed at one or both sides of the wall assembly by insertion of a suitable and typically resilient closure strip 57, often referred to as a light blocker.

Referencing the connector assembly 24, same includes a generally horizontally elongated activating rod or shaft 61 having a length which is less than the thickness of the edge frame rails 16 and 17 as defined between the side edge surfaces thereof. The activating rod 61 is provided with opposite-hand threads 62 and 63 adjacent opposite ends thereof.

Connector assembly 24 also includes a pair of clamping or gripping members 64 and 65 each having a generally flat center part 66 provided with a threaded center opening 69. The threaded openings 69 associated with the clamping members 64 and 65 are also of reverse thread direction, whereby the clamping members 64 and 65 are threadably engaged with the respective threads 62 and 63 associated with opposite ends of the activating rod 61.

Each clamping member 64-65 includes a pair of wing parts 67 cantilevered outwardly from opposite sides of the center part 66, and each wing part 67 defines on at least one exterior side thereof an exterior contact or wedge surface 68 which is generally flat and elongated in the vertical direction, but which when viewed horizontally is angled or sloped as it projects away from the flat surface of the center part 66. The slope or angle associated with the wedge surface 68 preferably corresponds to the slope provided on the opposed groove side surface 44 or 47 with which the wedge surface 68 is adapted to cooperate.

In the FIG. 2 embodiment, the clamping members 64 and 65 are formed from platelike material, preferably metal such as steel or aluminum, with each clamping member being formed to have a generally rectangular outer profile, and the wing parts 67 being suitably bent so as to slope outwardly away from the center part 66, whereby the clamping member when viewed in horizontal cross section has a shallow channel-like configuration. The channel-like configurations of the clamping members 64 and 65, when threadably mounted on opposite ends of the activating rod 61, opening outwardly in opposite directions. However, the angularity of the grooves as well as the channel-shaped configuration of the clamping members can be reversed so that all face inwardly, rather than outwardly as illustrated in FIG. 2, whereby the wedging cooperation between the wedging members and the grooved side walls would take place at inner side walls of the grooves.

To manually activate the connector assembly 24, either to join or disconnect adjacent panels, at least one end of the activator rod 61 is provided with a tool engaging part such as a tool-accommodating blind opening 70 which opens coaxially inwardly from one end of the rod 61. This opening 70 is preferably of hexagonal cross section and sized to accommodate one end of a standard Allen wrench which can be inserted into the slot 56 between adjacent panels so as to engage the tool opening 70 to effect rotation of the activator rod 61.

The installation and operation of the connector assembly 24 (FIG. 2) will now be briefly described.

Initially a pair of prefabricated wall panel assemblies 11 are positioned in adjacent upright relationship so that the upright edge frame rails 16 and 17 of respectively adjacent wall panel assemblies are disposed in closely adjacent but opposed relationship, generally as illustrated in FIG. 2. The adjacent disposition of the wall panel assemblies provides a small clearance slot 56 between the opposed edge frame rails. A plurality of connector assemblies 24, disposed in vertically spaced relationship along the height of the clearance slot 56, are then utilized to create a rigid securement between the adjacent frame rails 16 and 17 and to simultaneously effect alignment of the adjacent interconnected wall panel assemblies.

Assuming that the connector assembly 24 is in the desired vertical disposition between the opposed frame rails 16 and 17 so that the wing parts 67 associated with the gripping member 64 project into the opposed grooves 43, and the wing parts 67 associated with the gripping member 65 project into the opposed grooves 46, a tool such as an Allen wrench is inserted through the slot 56 to engage the tool opening 70 in the end of the activator rod 61, and is used to effect rotation of the activator rod 61. This rotation and the opposite-handed threaded connections to the gripping members 64 and 65 causes each of the gripping members 64 and 65 to be individually moved axially outwardly toward the free end of its respective thread, whereby the gripping members as a pair are moved axially away from one another, causing the gripping or wedging surfaces 68 on the gripping members to engage the sloped surfaces 44 and 47 defined on the outer side walls of the respective grooves. The engagement between these sloped surfaces on the grooves and the gripping members, in response to continued rotation of the activator rod 61 and continued outward movement of the gripping members 64 and 65, causes the opposed edge rail members 16 and 17 to be effectively pulled toward one another and also causes relative transverse (i.e. sideward) shifting of at least one of the edge rails 16-17 relative to the other until they are properly aligned. This drawing together and aligning of the opposed frame rails 16 and 17 continues until the stops 48 defined on the opposed rails 16 and 17 effectively abut opposite sides of the activator rod 61, at which time the adjacent frame edge rail 16 and 17 are aligned and fixedly joined in desired positional relationship to one another.

Disassembly between the adjacent panels occurs in a reverse manner to that described above.

To position the connector assemblies 24 between the adjacent edge frame rails 16 and 17, the connector assembly may be positioned adjacent one of the edge rail assemblies 16 or 17 and temporarily secured thereto. To permit initial positioning, the gripping members 64-65 are initially threaded inwardly away from the free ends of the rod so that the wing parts 67 can be moved transversely into the respective grooves, and the grooves 43 and 46 are provided with a width in the axial direction of the rod 61 which is significantly greater than the thickness of the wing part, thereby allowing the wing part to be inserted straight into the groove. When so positioned the connector assembly 24 is then temporarily secured to the rail assembly 16 such as by using a strip of adhesive tape (for example masking tape) to secure the rod 61 to the exterior edge surface 49 of the rail member 31. Thereafter the edge frame of an adjacent panel is moved into an adjacent and generally aligned position so that the other wing parts of the gripping member 64-65 protrude into the grooves 43 and 46 of the other edge frame rail 17. The activator rod 61 is then rotated by a tool and, since the gripping members 64-65 and their projection into the pairs of opposed grooves 43 and 46 prevent the members 64-65 from rotating, these latter members are hence individually threaded outwardly into engagement with the sloped wedge surfaces 44 and 47. Continued rotation of activator rod 61 causes the gripping members 64-65 to create a tight clamping and aligning engagement with the opposed frame rails 16 and 17 in the manner described above.

As an alternate installation technique, the lower ends of the frame rails 16 and 17, adjacent at least one side of the wall panel assembly, are provided with a small clearance opening (not shown) which is sized to permit the connector assembly 24 to be sidewardly inserted into the slot 56 so as to permit the gripping members 64-65 to align with the opposed pairs of slots 43 and 46. A small thin lifting member, such as the blade of a putty knife or screw driver, is inserted into the slot 56 and positioned below the connector assembly 24 for engagement therewith, whereupon lifting of the blade upwardly along the slot 56 causes the connector assembly 24 to be slidably moved vertically upwardly along the grooves until reaching the desired vertical position, at which time the activator rod 61 is rotated to effect movement of the gripping members 64-65 into gripping and aligning engagement with the sloped wedging side surfaces of the grooves.

While the connector 24 as illustrated by FIG. 2 and as described above has proven desirable for effecting drawing together and aligning of adjacent panels while creating a fixed connection between the adjacent panels, nevertheless installing and securing the connector assemblies to the panels, as briefly summarized above, involves installation procedures and manipulations which are of greater complexity and require greater installation time than is optimally desired. Accordingly, the present invention as described hereinafter relates to improvements associated with the connector assembly, which improvements particularly facilitate the initial installing and activating of the connector assembly so as to create a desired fixed securement of adjacent upright panels.

Referring to FIGS. 4 and 5, there is illustrated the improved connector assembly 24A according to the present invention. This improved connector assembly 24A incorporates many of the same or substantially similar structural and functional relationships as associated with the connector assembly 24, and accordingly parts of the improved connector assembly 24A which correspond to parts associated with the connector assembly 24 are identified by the same reference numeral with addition of an "A" thereto. Because of the high degree of structural and functional similarity, the corresponding parts of the improved connector assembly 24A may be only briefly described in the description presented hereinafter.

The improved connector assembly 24A is shown in FIG. 4 as creating a rigid connection between a pair of adjacent upright panels 11A. These adjacent panels have upright edge rails 16A and 17A disposed in adjacent but opposed relationship, with the edge rails having upright edge members 31A associated therewith. These edge members 31A are positioned in directly opposed relationship and create a narrow slot or gap 56A which extends transversely of the wall, with the improved connector 24A being positioned in this slot for creating the illustrated fixed securement to the opposed edge members 31A.

The connector assembly 24A includes an activator rod 61A which is positionable within the slot 56A so as to extend in the transverse or width direction of the wall assembly, and has threaded portions 62A and 63A defined at opposite ends thereof. The threaded portions 62A and 63A are of opposite hand, that is, one being a right-hand thread and the other being a left-hand thread. These threaded portions in turn are threadably engaged with a pair of wedge members 64A and 65A, these members being identical except for the reverse threading associated with the opening therethrough for cooperation with the respective thread on the activator rod 61A.

Each of the clamping members 64A-65A has a pair of wing parts 67A which are cantilevered outwardly from opposite sides of the center part 66A, and each wing part 67A defines on at least one exterior side thereof an exterior contact or wedge surface 68A which is generally flat and elongated in the vertical direction. The contact surface 68A, when viewed horizontally, is angled or sloped relative to the central upright plane 15A of the panel as the wing part projects outwardly from the center part 66A, with the inner end of this surface 68A terminating in a smooth, rounded corner for joinder to the side of the center part 66A. This contact surface 68A hence effectively defines a concave-shaped recess which opens axially in an outward direction.

Each of the edge members 31A has a pair of sidewardly-spaced vertically-extending grooves 43A and 46A formed therein, which grooves open outwardly for communication with the clearance space or slot 56A. These grooves 43A and 46A are sized and positioned so as to accommodate therein the sidewardly projecting wing parts 67A associated with the clamping members 64A and 65A.

Each of the grooves 43A and 46A is defined between a pair of sidewardly-spaced ribs 91 and 95 which extend vertically along the main strip member 31A and protrude exteriorly thereof. The rib 91 defines the outermost side of the respective groove and has a generally L-shaped cross section which defines an inner or tip part 92 which is cantilevered inwardly and terminates at a rounded or convex-shaped nose part 93, the latter being spaced from the main body of the strip 31A due to a groove or recess 94 defined therebetween, and protruding axially in an inward direction. This protruding rounded nose part 93, and its associated adjacent recess 94 as illustrated by FIG. 4, cooperates with the concave or recess-shaped contact surface 68A associated with the respective wing part 67A so as to effect drawing in of the opposed edge member, and rigid clamping of the connector assembly 24A to the opposed edge members 31A.

The other or inner side of each of the grooves 43A and 46A is defined by the inner rib 95, the latter terminating in an inner stop part 96 which is adapted to seat against the activating rod 61A and hence function as a stop member when the connector assembly 24A creates a fixed interconnection between the opposed edge rails substantially as illustrated by FIG. 4.

Each of the clamping members 64A and 65A is provided with a clamping part 98, the latter being associated with solely one side of the clamping member and in the illustrated embodiment being associated specifically with only one of the wing parts 67A. This clamping part 98 is fixed to the rear side of the respective wing part, namely the side opposite the contact or wedge surface 68A, and protrudes axially inwardly through a sufficient distance so as to be effectively cantilevered axially beyond the rear surface 101 of the diametrically opposite wing part 67A. This clamping part 98 is intended to be moved into clamping engagement with the side surface of the inner rib 95 when the connector assembly 24A is in the installation position illustrated by FIG. 5. This installation position enables the connector assembly 24A to be securely and fixedly maintained in engagement with the edge member 31A associated with a single wall panel so as to facilitate the mounting of the connector assemblies onto the edge member of a single wall panel, prior to the wall panel being joined to an adjacent wall panel. The clamping part 98, as illustrated by FIGS. 4-5, has a rib 99 which extends vertically therealong and protrudes axially inwardly toward the opposed rib or wall 95. The rib 99 has a rounded or convex-shaped exterior cross-section, and is adapted to project into a concave-shaped recess or groove 97 which extends vertically along the side surface of the inner rib 95. The seating of the rib 99 into the groove 97, when in the installation position illustrated by FIG. 5, ensures that the connector assembly 24A is properly seated on the edge member 31A when in its installation position. At the same time, this enables slight loosening of the clamp parts relative to the ribs 95, while at the same time maintaining the protrusions 99 at least partially within the grooves 97, thereby permitting the connector assembly 24A to be slidably moved vertically along the edge member, while preventing the connector assembly from sidewardly separating from the edge member.

Figure 3:
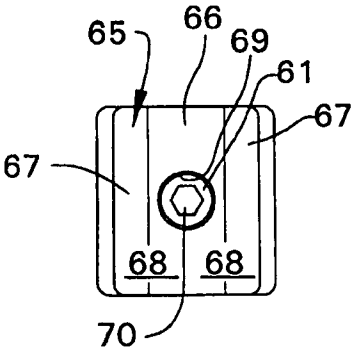
FIG. 3 is an end view of the connector assembly shown in FIG. 2.

The activator rod 61A is again provided with a tool-engaging portion associated with at least one end thereof, such as a tool-engaging opening similar to the opening illustrated in FIG. 3, as described above. The other end of the rod 61A can also be provided with a transverse slot to accommodate the flat blade of a screw driver if desired.

The installation and operation of the improved connector assembly 24A will now be briefly described.

The connector assembly 24A is initially fixedly secured to solely a first upright panel. This connector assembly can be secured to the edge member 31A of the first panel either prior to or after the upright panel is disposed in an upright position at its desired location. To secure the connector assembly 24A to the edge member 31A, the connector 24A is manually positioned sidewardly adjacent the edge member 31A so that the wing parts 67A having the clamping parts 98 associated therewith are both disposed on the same diametral side of the activating rod 61A, and are oriented radially toward and generally aligned with the channels or grooves 43A and 46A. The connector assembly 24A is then moved laterally toward the edge member 31A so that the wing parts 67A having the clamping parts 98 associated therewith are inserted into the respective grooves 43A and 46A. The connector assembly 24A is then manually held in this position, and the activating rod 61A is rotated to cause the clamping members 64A and 65A to be moved inwardly toward one another until the protruding clam ping parts 98 are moved into clamping engagement with the concave-shaped wall configuration defined on the opposed respective side wall ribs 95, substantially as illustrated by FIG. 5. When moving into this position, the protrusion 98 draws into the respective groove 97 in order to effect proper seating of the protrusion 99 against the side surface of the rib 95. The wing parts are appropriately tightened into secure gripping engagement with the opposed side-wall ribs 95 by appropriate. rotational displacement of the activator rod 61A. If vertical positional adjustment of the connector assembly 24A is desired, then the clamping members can be slightly loosened by a small reverse rotation of the activator rod 61A, while at the same time maintaining the protrusions 99 at least partially engaged within the grooves 97, thereby enabling the entire connector assembly 24A to be vertically slidably displaced along the edge member 31A, and then resecuring the connector assembly 24A to the edge member at the desired elevational position.

Using the same general procedure, a plurality of connector assemblies 24A can be secured to the same edge member 31A at desired vertical positions therealong The connector assemblies 24A can hence be positively and securely mounted on the edge member 31A at the desired locations, and maintained at these desired locations without requiring any temporary securing structure or element. The installing and securing of the connector assembly 24A to this first edge panel can also be accomplished prior to the first panel being interrelated to a second panel, thereby providing full and hence convenient access to the edge member and to the connector assemblies. Thereafter a second upright panel is positioned in adjacent and generally aligned relationship to the first panel so that an edge member of the second panel is disposed adjacent and in generally opposed relationship to the edge member of the first panel, which edge member has the connector assemblies mounted thereon generally as illustrated by FIG. 5. The second panel is then moved laterally toward the first panel so that the exposed wing parts 67A (i.e., the wing parts shown on the left side in FIG. 5) protrude into the grooves 43A and 46A associated with the edge member on the second panel. When the second panel is so positioned, then the installer sequentially activates and joins the two panels together by each of the previously mounted connector assemblies. That is, the operator rotates the activator rod 61A in a direction which causes the clamping members 64A and 65A to be moved in opposite directions outwardly away from one another, namely away from the installation position of FIG. 5 toward the securing or connecting position of FIG. 4. When the clamping members 64A and 65A approach the outer side ribs 91, the contact or wedge surfaces 68A engage the rounded protruding walls 93, which effectively function as wedges, whereby the wing parts 67A cooperate with these wedges 93 so as to not only cause the opposed edge members 31A to be drawn toward one another, but also drawn into aligned relationship with one another. This wedging relationship between the wing parts 67A and the wedges 93 continues until the clamping members are fixedly seated against the wedges 93 provided on the adjacent first and second panels, whereby the connector assembly 24A hence creates a fixed securement or joining of the adjacent first and second panels together.

Each of the connector assemblies 24A as secured to the edge member 31A of the first panel is activated in generally this same manner so as to effect fixed joining of the first and second panels together at a plurality of vertically spaced locations.

If necessary or desired, when the connector assembly 24A is activated so as to move it from the installation position of FIG. 5 into the adjoining or securing position of FIG. 4, a suitable support tool such as the blade of a screwdriver can be inserted into the slot 56A and positioned directly below the connector assembly 24A to maintain it at the desired elevational position during the time interval that it takes to move the clamping members 64A and 65A from the installation position of FIG. 5 into the joining position of FIG. 4.

It will be appreciated that disassembly between rigidly joined first and second panels will generally take place by reversing the assembly sequence described above. With the improved connector assembly 24A of the present invention, as described above, the clamping members 64A and 65A always move simultaneously in opposite directions as a result of activation or rotation of the activator rod, and hence are movable into and between two end positions. When in one end position, the diametrically opposite wing parts associated with both clamping members can be brought into clamping engagement with a pair of adjacent but opposed edge rails as associated with adjacent first and second panels to hence create a fixed aligning and adjoining of the adjacent panels. Conversely, however, when the clamping members 64A and 65A are moved into the other end position, only the wing parts provided on one diametral side of the connector assembly are capable of moving into fixed clamping or gripping engagement with only a single edge rail, thereby defining an installation position which greatly facilitates the initial mounting of the connector assemblies on the panel edge rail without requiring that a second panel be positioned in closely adjacent and aligned edge-to-edge relationship therewith. At the same time, when the clamping members are in this second position (that is the installation position) so as to be adjoined to solely the edge member of a first panel, the remaining exposed wing parts as defined generally on the other diametral side of the connector assembly are positioned such that they can be readily inserted into the edge grooves associated with the edge rail of a second panel, thereby facilitating movement of the second panel into adjacent and aligned relationship to the edge of the first panel, without requiring any movement or activation of the connector assembly during the initial positioning of the second panel. The connector assemblies hence can be activated and the clamping members moved from the installation position to the joining or securing position only after the second panel has been positioned closely adjacent the first panel so that the exposed wing parts protrude into the respective grooves.

Figure 7:
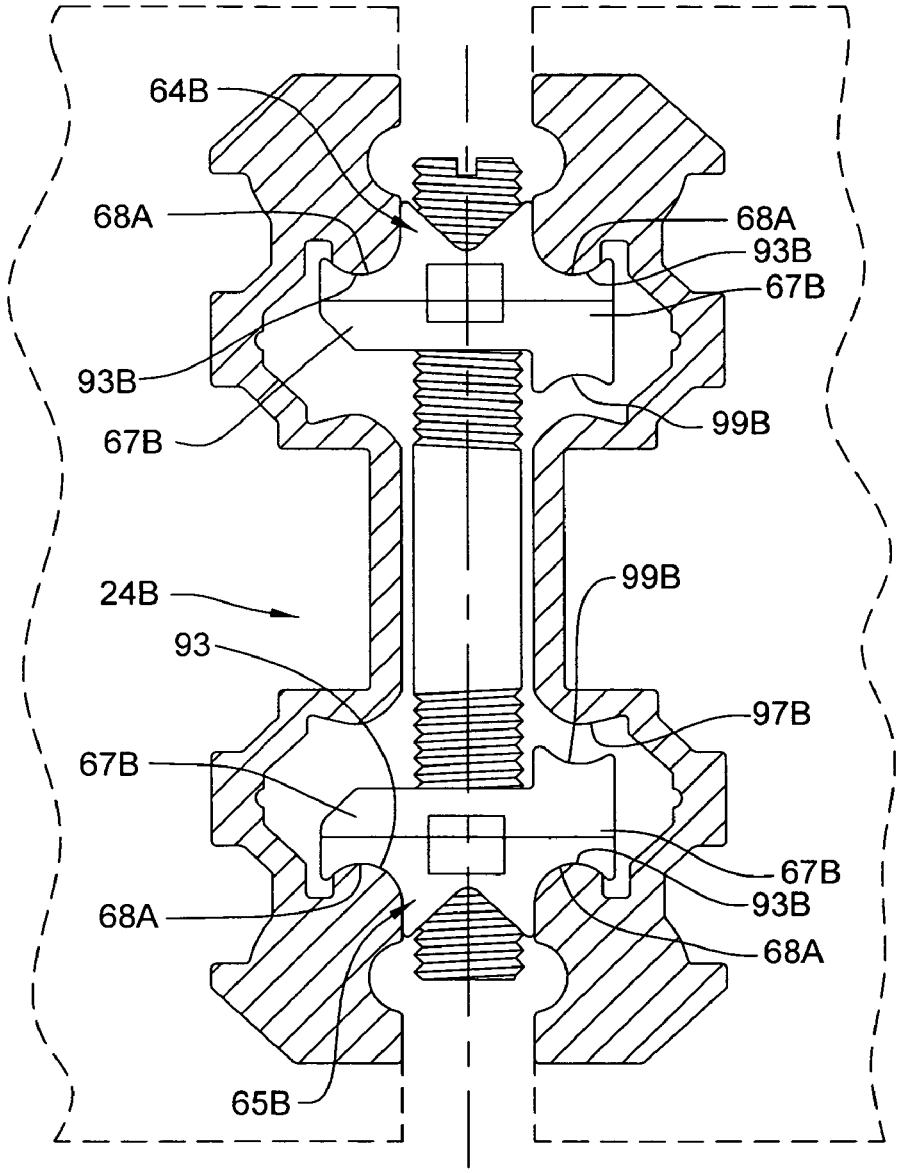
FIGS. 7 and 8 are views which respectively correspond to FIGS. 4 and 5 but which illustrate a variation of the connector assembly of this invention.
Figure 8:
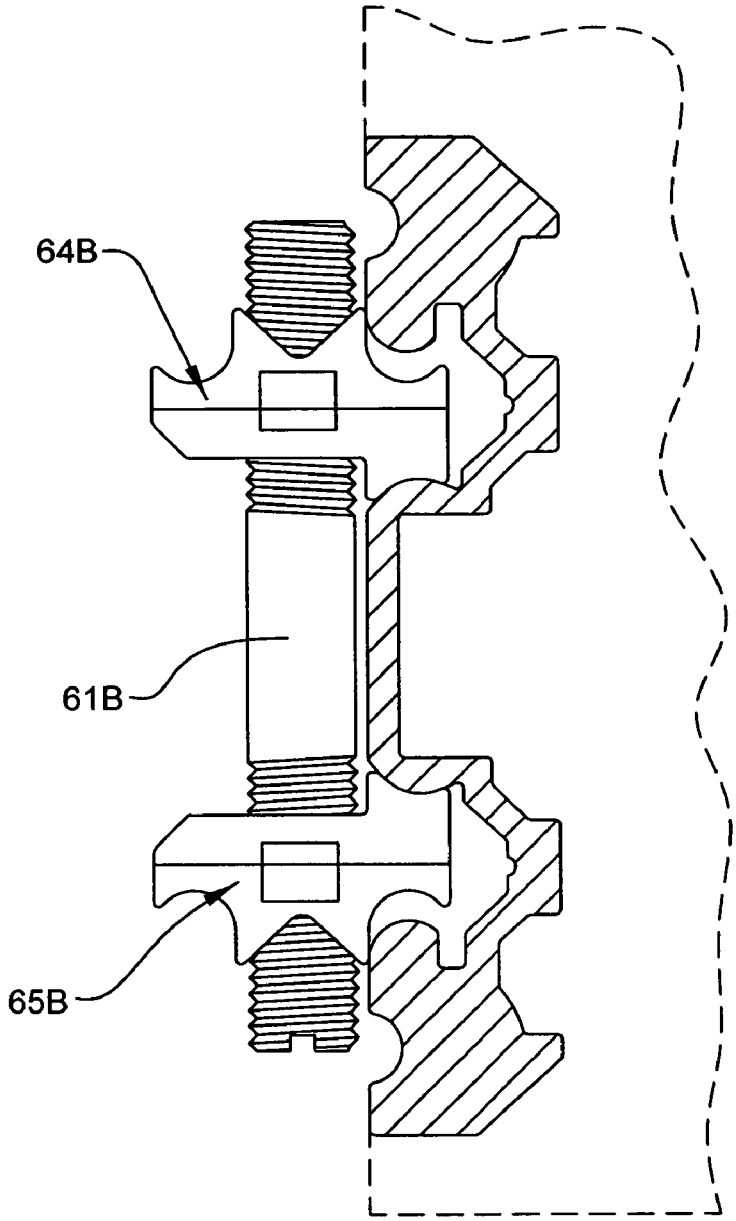
Figure 9:
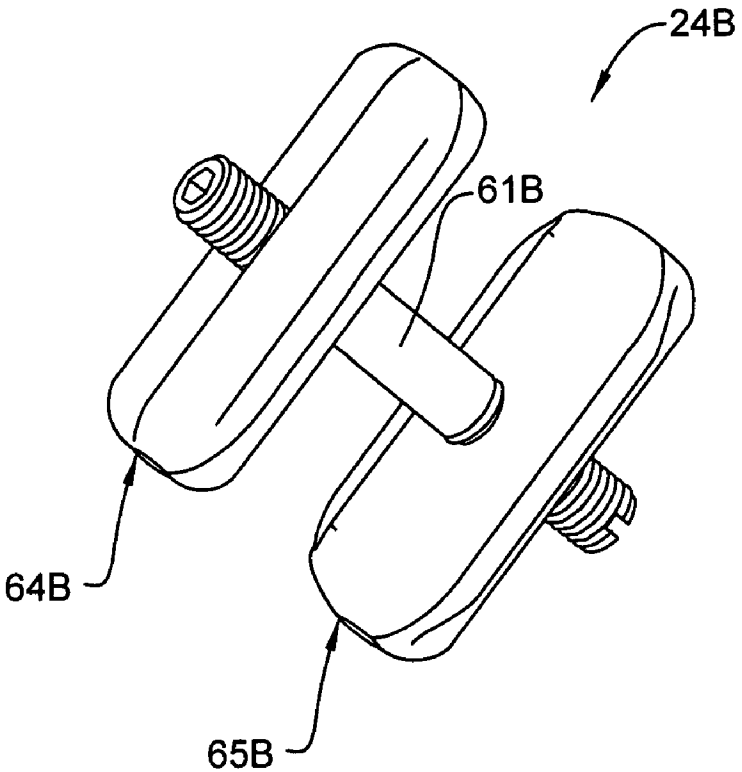
FIG. 9 is a perspective view of solely the connector assembly shown in FIGS. 7 and 8.

Referring now to FIGS. 7 and 8, they are views which respectively correspond to FIGS. 4 and 5 but which illustrate a variation of the connector assembly 24B of this invention. More specifically, in the variation depicted by FIGS. 7-8, the edge frames of the panels are provided with a configuration which is similar to but slightly different from the configuration of the edge frames depicted in FIGS. 4-5, and in addition the gripping members 64B, 65B associated with the connector assembly 24B in this variation (FIGS. 7-8) also have a slightly different shape or configuration in comparison to the corresponding gripping members utilized on the connector assembly 24A of FIGS. 4-5. However, the structural and functional relationships of the variation shown in FIGS. 7-8 are substantially the same as those possessed by the variation shown by FIGS. 4-5. Accordingly, in this variation (FIGS. 7-8) corresponding parts of the edge members and of the connector assembly are designated by the same reference numerals utilized to designate the corresponding parts in the aforementioned FIGS. 4-5 variation except for addition of the suffix "B" to the identifying reference numeral.

Referring specifically to the variation illustrated by FIGS. 7-8, one of the primary differences in this variation, in contrast to the variation depicted by FIGS. 4-5, is a reversal with respect to the opposed concave/convex relationships defined on the gripping members 64B, 65B and the opposed ribs of the edge frame. For example, the contacting surfaces 68B formed on the wings 67B of the gripping members are defined as concave recesses which are disposed in opposed cooperating relationship to the convex protrusions 93B formed on the edge rail, in contrast to the concave gripping surface 68A (FIGS. 4-5) and its cooperation with the opposed convex protrusion 93B associated with the edge frame. Similarly, the concave recess defining the gripping surface 99B as associated with only one diametral side of the gripping member cooperates with the opposed protruding convex gripping surface 97B formed on the edge frame, this again being a reversal of the concave/convex relationship associated with the gripping protrusion 99 and opposed recess 97 associated with the variation of FIGS. 4-5.

Other than these variations with respect to the manner in which the opposed gripping surfaces cooperate due to an outward protrusion on one surface cooperating with a recess or an inward protrusion on an opposed surface, the overall operation of the connector assembly 24B and its cooperation with the edge rails as illustrated by FIGS. 7-8 is otherwise the same as the operation associated with the connector 24A as illustrated by FIGS. 4-5.

While the connector assembly 24A or 24B illustrates the joining position being defined by the clamping parts being in outermost end positions and the installation position being defined with the clamping members in innermost end position, it will be appreciated that these positional relationships can be reversed if desired. However, having the clamping members in their outermost end positions for defining the adjoining position is preferred since this provides two regions of fixing between the adjacent panels with these two regions being spaced a further distance apart so as to provide optimum rigidity between the joined edges of the adjacent panels.

With the present invention, the wall panel assemblies can be fully fabricated and assembled prior to their being shipped to the job site, whereby upon receipt at the job site the installation of the wall panel assemblies and the joining together of such assemblies by the connector assemblies 24A or 24B hence greatly facilitates and expedites the creation of the desired upright wall.

The connector assembly 24A or 24B and its association with the upright edge rails provided on the panel assembly hence provides a highly desirable overall relationship in that it provides a secure and relatively rigid joining of adjacent panels and ensures that adjacent panels properly align as they are being adjacently rigidly joined, and at the same time the connector assemblies are effectively disposed entirely within the exterior wall profile (i.e., within the thickness of the wall as defined by the thickness of the edge frame rails), whereby the connector assemblies can be readily manually manipulated for both connecting or disconnecting adjacent wall panel assemblies, but at the same time the installed connector assemblies are effectively hidden and do not visually impact the exterior appearance of the assembled wall.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. An interior upright wall arrangement, comprising:

at least first and second upright wall panels for supportive disposition on a floor, said first and second panels being positioned in adjacent and upright relationship so that the first and second panels are horizontally aligned in a widthwise direction thereof;

said first and second panels having respective first and second elongate upright edge rails defining thereon edge faces which are disposed in adjacent but opposed facing relationship to define a small space therebetween;

a plurality of vertically spaced connector assemblies positioned horizontally in said space between and fixedly but releasably engaged with said first and second edge rails for fixedly connecting said first and second panels together in said horizontally aligned widthwise direction;

each of said first and second edge rails having a pair of parallel elongate grooves disposed in sidewardly spaced relation and extending vertically along said rails and having a mouth opening outwardly of the respective edge face, the mouth of one of said grooves on said first edge rail being disposed horizontally opposite and substantially aligned with the mouth of one of the grooves on said second edge rail;

the pair of grooves of each said edge rail, as the grooves open inwardly from the respective edge face, defining a pair of oppositely sidewardly facing wedge arrangements;

each said connector assembly including a connector member positioned between the horizontally opposed edge faces of said first and second panels and elongated horizontally in a thickness direction of the panels;

each said connector assembly including a pair of transversely enlarged gripping members carried on said connector member in spaced relationship therealong so that rotation of said connector member about its elongate axis causes the pair of gripping members to move longitudinally in opposite directions relative to said connector member;

each said gripping member having a pair of wedge parts cantilevered outwardly from opposite sides thereof and defining thereon a pair of wedge surfaces which are in angled relationship to one another and engage said wedge faces defined on said grooves;

each said connector assembly being positionable between the opposed edge faces of the first and second edge rails so that the wedge parts project into the pairs of opposed grooves, and said connector member being rotatable in one direction to cause the gripping members to move lengthwise relative to the connector member in opposite directions into a first end position causing the wedge surfaces to engage the wedge arrangements and simultaneously cause the first and second panels to align as they are drawn together into a fixed position;

each said gripping member on only one diametrial side thereof having a clamping part fixed to one of said wedge parts and protruding axially outwardly from a rear side thereof so as to be disposed in opposition to a side of the elongate groove which is opposite the respective wedge arrangement; and each said connector member being reversely rotatable to cause the pair of gripping members to move into a second end position wherein the clamping parts fixedly clampingly engage only a single said edge rail.

2. A wall arrangement according to claim 1, wherein each said connector member has a tool-engaging part defined at one end thereof for engagement with a tool insertable between the opposed edge faces for effecting rotation of the connector member.

3. A wall arrangement according to claim 1, wherein the wedge arrangement associated with each groove of each pair opens inwardly of the respective edge rail in angled relation relative to the horizontal widthwise direction of the aligned panels, and wherein the wedge surface on each said wedge part is angled relative to the horizontal widthwise direction of the aligned panels.

4. A wall arrangement according to claim 3, wherein the associated with each groove of each pair wedge arrangement includes a transversely protruding rib extending vertically along the mouth of the respective groove, the rib terminating in a rounded free end for cooperative engagement with the respective wedge surface, and a recess being defined between said rib and a base wall of said groove.

5. A wall arrangement according to claim 1, wherein the opposed grooves on said first and second edge rails define a first opposed pair of grooves adjacent but spaced inwardly from one exposed upright side of the wall arrangement, and define a second opposed pair of grooves adjacent but spaced inwardly from the other exposed side of the wall arrangement.

6. A wall arrangement according to claim 5, wherein the grooves defining said one opposed pair have the wedge arrangements thereon projecting horizontally in oppositely angled relationship relative to the horizontal widthwise direction, and wherein the wedge surfaces on the wedge member which engages the grooves of said first opposed pair also extend horizontally in oppositely angled relation relative to the horizontal widthwise direction.

7. A wall arrangement according to claim 1, including horizontally projecting stop elements cooperating between said connector member and the edge faces of said first and second edge rails for limiting the aligned inward drawing of the first and second panels toward one another.

8. A wall arrangement according to claim 7, wherein the stop surfaces are defined by a pair of sidewardly spaced but substantially parallel ribs which are vertically elongate along the edge face and which are formed on each said edge rail and project horizontally outwardly away from the respective edge face for contacting engagement with said connector member when the panels are tightly drawn together.

9. A wall arrangement according to claim 8, wherein the parallel ribs define side walls of the parallel guide grooves.

10. A wall arrangement according to claim 1, wherein each said connecting member is a horizontally elongate rod having a length less than the transverse width of the edge rails, a tool engaging part being defined at one end of said rod and positioned in inwardly spaced relation from the adjacent exposed exterior side of the wall arrangement, and said gripping members surrounding and being threadably engaged on said rod adjacent opposite ends thereof.

11. A wall arrangement according to claim 10, wherein each said gripping member is a one-piece member which includes a generally block-like center part which is threadably engaged with the rod, and includes said wedge parts cantilevered outwardly from opposite sides of the center part, the gripping member at one end thereof having an end surface defining a shallow channel-like horizontal cross section, said end surface being defined at least in part by said wedge surfaces, and the end surfaces on said gripping members being oppositely axially oriented relative to the lengthwise direction of said rod.

12. A wall arrangement according to claim 1, wherein the wedge surfaces are all angled horizontally relative to said horizontal widthwise direction at an angle of about 30°.

13. A wall arrangement according to claim 1, wherein the opposed first and second edge rails have outer rail parts which are positioned closely adjacent but are horizontally spaced a small distance apart to define a narrow upright slot therebetween for accessing said connector assembly, and a removable resilient vertically elongate strip releasably fitted into said slot.

14. An interior upright wall arrangement, comprising:

first and second upright wall panels positioned horizontally aligned in a lengthwise direction thereof;

said first and second panels having respective first and second elongate upright edges disposed in opposed facing relationship to define a small space therebetween;

each said edge including first and second sidewardly-spaced vertically elongate wall parts which protrude toward the opposed edge;

each edge having a third vertically-elongate wall part which protrudes toward the opposed edge and is spaced sidewardly from said first and second wall parts;

an adjustable connector assembly positioned between and fixedly but releasably engaged with said first and second edges for fixedly connecting said first and second panels together in said horizontally aligned lengthwise direction;

said connector assembly including a horizontally-elongated rotatable connector rod having right-hand and left-hand external threads provided thereon;

said connector assembly including first and second transversely-enlarged gripping members carried on said connector rod in axially spaced relation therealong, said first and second gripping members being respectively disposed in threaded engagement with the right-hand and left-hand external threads;

each said gripping member having a pair of gripping parts disposed on diametrically opposite sides of the connector rod and which define thereon a pair of sidewardly-spaced gripping surfaces which face generally axially relative to the connector rod, the gripping surfaces on said first gripping member facing in one axial direction in opposed facing relationship to said first wall part, the gripping surfaces on said second gripping member facing in the opposite axial direction in opposed facing relationship to the second wall part, whereby rotation of the connector rod in one direction causes the first and second gripping members to move toward the respective first and second wall parts associated with both of the first and second edges to create a fixed gripping engagement with both edges; and each said gripping member having a further gripping part which is provided adjacent only one diametral side of the connector rod and which defines thereon a gripping face which faces axially in the opposite direction from the gripping surfaces associated with the respective gripping member, said further gripping parts as associated with both of said first and second gripping members being positioned on the same diametral side of said connector rod, said gripping faces on said first and second gripping members facing axially in opposite directions, each said gripping face being disposed in opposed facing relationship to said third wall part of solely said first edge, whereby reverse rotation of the connector rod causes said further gripping parts to be moved axially in opposite directions into fixed gripping engagement with said third wall part to fixedly connect the connector assembly to solely said first edge independent of the presence or absence of said second edge.

15. A wall arrangement according to claim 14, wherein said third wall part is defined by two sidewardly-spaced wall parts which are positioned for respective engagement with only a respective one of said gripping faces.

16. A wall arrangement according to claim 15, wherein each gripping member when viewed in the axial direction of the connector rod has a generally rectangular profile and can be moved vertically along the edges, the rectangular profile preventing the gripping members from rotating when the connector rod is rotated.

17. A wall arrangement according to claim 16, wherein the pair of gripping surfaces associated with each said gripping member and the associated wall part with which it engages define a wedgelike engagement, said wedgelike engagement as created by the respective first and second gripping members being sloped in opposite direction relative to a central upright plane of the panel, whereby said wedgelike engagements created by the first and second gripping members as they engage the respective wall parts assist in drawing the first and second edges together and then creating a fixed connection therebetween.

* * * * *

UNITED STATES PATENT AND TRADEMARK OFFICE

CERTIFICATE OF CORRECTION

PATENT NO. : 7,434,364 B2
APPLICATION NO. : 11/304392
DATED : October 14, 2008
INVENTOR(S) : Scott MacDermott et al.

It is certified that error appears in the above-identified patent and that said Letters Patent is hereby corrected as shown below:

Column 14, line 14, change "associated with each groove of each pair wedge arrangement" to --wedge arrangement associated with each groove of each pair--

Signed and Sealed this

Thirteenth Day of January, 2009

JON W. DUDAS
*Director of the United States Patent and Trademark Office*